United States Patent [19]

Houle et al.

[11] Patent Number: 4,954,233

[45] Date of Patent: Sep. 4, 1990

[54] COMBINATION ANODE MOUNT AND HOT WATER OUTLET UTILIZING A CAM LOCK

[75] Inventors: Timothy H. Houle, Wauwatosa; Robert M. Schurter, Elm Grove, both of Wis.

[73] Assignee: A. O. Smith Corporation, Milwaukee, Wis.

[21] Appl. No.: 390,971

[22] Filed: Aug. 7, 1989

[51] Int. Cl.[5] ..... C23F 13/00

[52] U.S. Cl. ..... 204/197; 204/148

[58] Field of Search ..... 204/147, 148, 196, 197

[56] References Cited

U.S. PATENT DOCUMENTS

| | | | |
|---|---|---|---|
| 2,642,391 | 1/1953 | Wellman . | |
| 2,656,314 | 10/1953 | Osterheld | 204/197 |
| 3,558,463 | 1/1971 | Strobach et al. . | |
| 3,718,571 | 2/1973 | Bidwell | 204/197 |
| 3,758,888 | 8/1973 | Alewitz | 204/197 |
| 3,864,234 | 2/1975 | Wasson | 204/197 |
| 3,867,274 | 1/1975 | Herman | 204/197 |
| 3,891,530 | 6/1975 | Alewitz | 204/197 |
| 3,907,658 | 9/1975 | Watson | 204/197 |
| 3,953,311 | 4/1976 | Wasson | 204/197 |
| 4,093,529 | 6/1978 | Strobach | 204/197 |
| 4,113,600 | 9/1978 | Cook | 204/197 |
| 4,224,126 | 9/1980 | Bidwell | 204/197 |
| 4,286,573 | 9/1981 | Nickel | 126/362 |
| 4,773,977 | 9/1988 | Houle et al. | 204/147 |

*Primary Examiner*—T. Tung

*Attorney, Agent, or Firm*—Andrus, Sceales, Starke & Sawall

[57] ABSTRACT

A combination anode mount and hot water outlet for a water heater. The water heater includes a steel tank to contain water to be heated and has an upper head formed with an opening therein. An annular internally threaded spud is secured to the upper surface of the head with the axis of the spud being located eccentrically with respect to the axis of the head opening. An elongated body or support formed of an electrically insulating material, such as plastic, extends through the opening in the head and a cam shaped flange extends laterally from the upper end of the body and is disposed within the spud and is supported on the upper surface of the head. The body is formed with an outlet passage which communicates with the interior of the tank so that heated water in the tank can flow through the passage for discharge. An anode is secured to the lower end of the body and an electrical connector embedded in the body is connected to the anode and extends upwardly and is exposed at the cam flange. By rotating the body within the opening in the head, the cam will wedge against the threads of the spud to lock the body against rotation and provide a positive electrical connection between the electrical connector and the spud.

18 Claims, 1 Drawing Sheet

FIG. 1
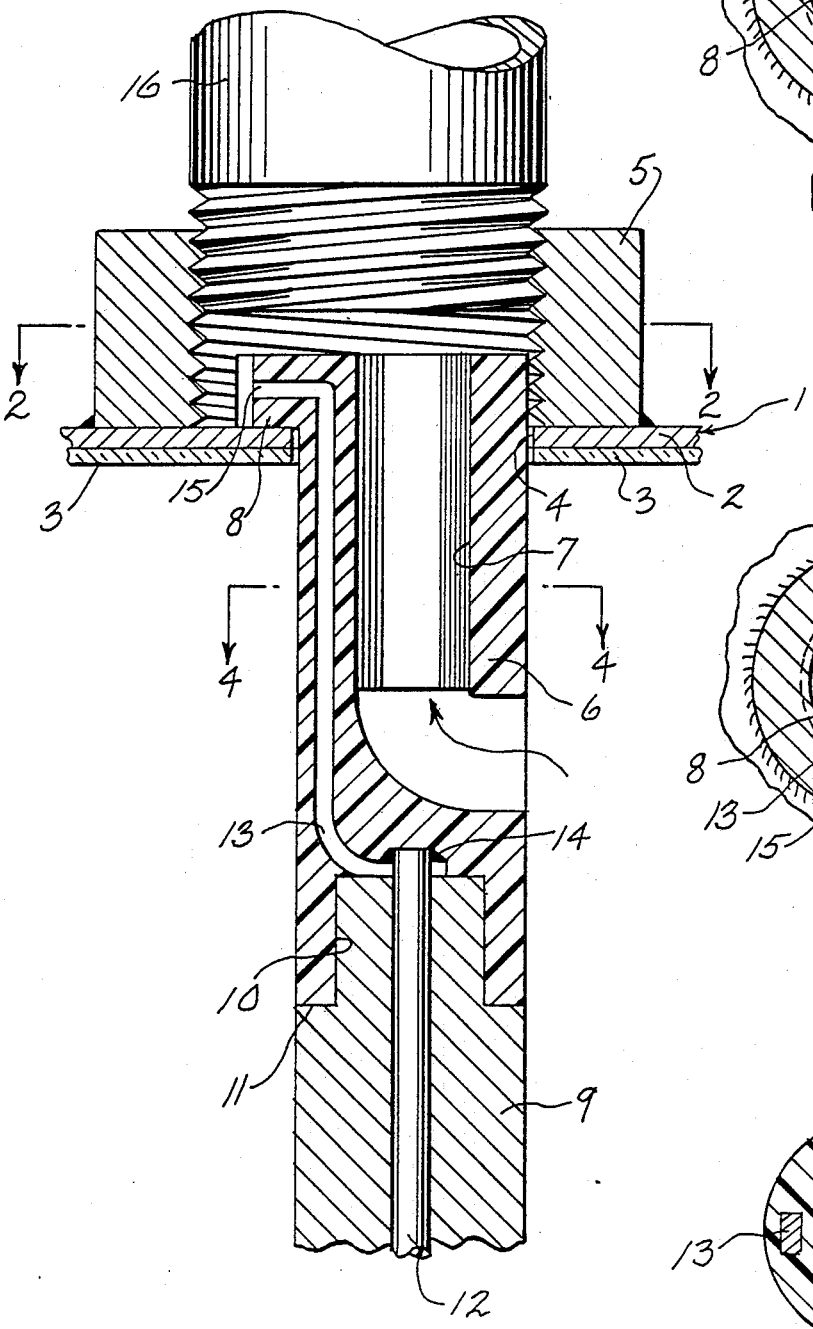
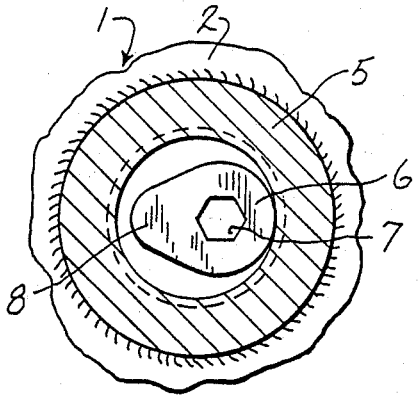
FIG. 2
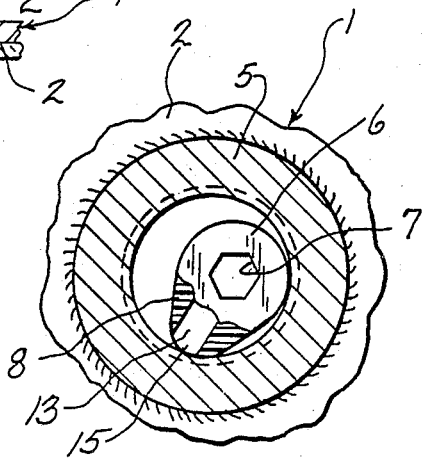
FIG. 3
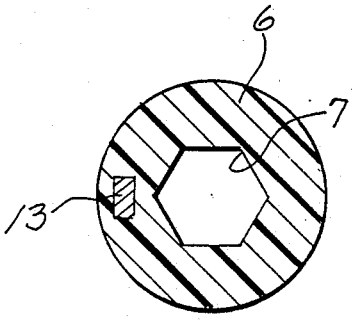
FIG. 4

COMBINATION ANODE MOUNT AND HOT WATER OUTLET UTILIZING A CAM LOCK

BACKGROUND OF THE INVENTION

A storage type water heater includes a tank to contain water to be heated. Cold water is introduced into the lower end of the tank while heated water is withdrawn from an outlet in the upper head of the tank. The water heater tank is normally composed of steel, and to prevent corrosion of the steel tank, a corrosion resistant coating, formed of vitreous enamel or plastic, is normally applied to the inner surface of the tank. In practice, it is difficult to completely coat certain areas of the steel tank, such as areas bordering openings in the tank or the joints between the cylindrical shell and heads of the tank. In addition, the corrosion resistant coating may contain minor imperfections. As a result, intensified corrosion can occur at the exposed steel areas of the tank.

As a consequence, it has been the practice to install an anode formed of a metal electro-negative to steel, such as aluminum, zinc or magnesium, in the tank. The anode generally takes the form of an elongated rod and the upper end of the anode extends through an opening in the upper head of the tank and is supported from an annular spud that is welded to the outer surface of the upper head. With the use of an anode, a galvanic circuit is set up in which the anode will corrode preferentially to thereby prevent corrosion of the exposed areas of the steel tank.

However, the use of an anode normally requires a separate opening in the tank head. Therefore, it has been proposed to combine an anode mount and a hot water outlet so that only a single opening in the upper head is required U.S. Pat. No. 4,060,472 describes a combination anode mount and hot water outlet which includes a plastic tube that extends downwardly through an opening in the upper head of the tank and the plastic tube is provided with a transverse wall that divides the tube into an upper water outlet chamber and a lower chamber. Openings are provided in the wall of the plastic tube and establish communication between the tank and the upper chamber of the tube, thereby serving to conduct heated water from the tank through the tube to the water piping system.

In the construction of the aforementioned patent, the upper end of an anode rod is mounted in the lower chamber of the plastic tube and a metal sleeve is molded in the plastic tube and provides an electrical connection between the upper end of the anode and a metal nipple which is located on the outer surface of the upper end of the plastic tube. The nipple is threaded in a stud welded to the upper head of the tank and bordering the opening in the tank.

With the construction of U.S. Pat. No. 4,060,472 the plastic tube, metal sleeve and anode are locked together by compression rolling.

It has been found that with the construction of the aforementioned patent, leakage can occur between the nipple and the plastic tube, thereby causing corrosion of the upper end of the internal metal sleeve. Similarly, leakage can also occur between the anode and the plastic tube resulting in corrosion of the lower end of the metal sleeve. Corrosion of the metal sleeve will increase the electrical resistance and thus reduce the effectiveness of the anode. In certain situations, the corrosion may be so severe that the electrical connection between the anode and the nipple is destroyed.

SUMMARY OF THE INVENTION

The invention is directed to an improved combination anode mount and hot water outlet for a storage type water heater utilizing a cam lock to provide an electrical connection between the anode and the tank. In accordance with the invention, an annular internally threaded spud is secured to the outer surface of the tank head in eccentric relation with respect to an opening in the head. The opening in the spud has a larger diameter than the opening in the head. A body or support formed of an electrically insulating material, such as plastic, extends through the opening in the head and the upper end of the body is provided with a cam-shaped flange that rests on the upper surface of the head and is disposed within the spud. The upper end of the body is provided with a passage and the passage extends through the side of the body and communicates with the interior of the tank so that heated water from the tank can flow through the passage for discharge.

An anode formed of a metal electro-negative to steel, such as aluminum, magnesium or zinc, is mounted in an axial recess in the lower end of the body. An electrical connector that is embedded within the body is connected to the anode and extends upwardly, with the upper end of the connector being exposed at the side of the cam.

By rotating the body within the opening in the head, the cam will be wedged into contact with the internal threads of the spud to lock the body against rotation and provide a positive electrical connection between the electrical connector and the spud.

A tubular nipple is threaded to the upper end of the spud and provides communication to the water system.

With the invention, the anode mounting structure and the hot water outlet are combined and are connected through a single opening in the tank head, thus eliminating the need for separate openings for both the anode and the hot water outlet. This not only reduces the cost of the water heater, but also eliminates a potential area of corrosion, i.e., the edge bordering the head opening whch may be inadequately coated with glass, and the steel spud which is exposed through the opening.

The construction of the invention provides a positive electrical connection between the anode and the tank and eliminates the problems resulting from the use of a compression connection as used in the past.

As the body is formed of a plastic material without any metal components, except for the electrical connector, problems of corrosion of the body are eliminated. In constructions utilizing a steel body or support, the steel must be protected or coated to prevent intensified corrosion or "necking-down" of the anode adjacent the body.

The construction of the invention also provides a positive lock of the body to the spud without the necessity of forming threads in the plastic body.

Other objects and advantages will appear in the course of the following description.

BRIEF DESCRIPTION OF THE DRAWINGS

The drawings illustrate the best mode presently contemplated of carrying out the invention.

In the drawings:

FIG. 1 is a longitudinal section anode mount and hot water outlet of the invention;

FIG. 2 is a section taken along line 2—2 of FIG. 1 and showing the cam in the unlocked position;

FIG. 3 is a view similar to FIG. 2 and showing the cam in the locked position; and FIG. 4 is a transverse section taken along line 4—4 of FIG. 1.

DESCRIPTION OF THE ILLUSTRATED EMBODIMENT

The drawings illustrate a combination anode mount and hot water outlet for a storage type water heater. The water heater includes a tank 1 normally formed of steel which is adapted to contain water to be heated. Tank 1 includes an upper head 2 and the interior surface of tank 1, including head 2, is normally coated with a corrosion resistant material 3, such as glass or vitreous enamel, plastic or the like.

Head 2 is provided with an opening 4 and an annular internally threaded metal spud 5 is secured, as by welding, to the upper surface of head 2. As shown in FIG. 1, the opening in spud 5 is larger than opening 4 and the axis of spud 5 is located eccentrically with respect to the axis of opening 4.

The combination anode mount and hot water outlet includes a body or support 6 formed of an electrically insulating material, such as nylon. Body 6 can be reinforced with chopped fibrous materials, such as glass fibers.

As shown in FIG. 1, body 6 is formed with a longitudinal hot water discharge passage 7 and the lower end of the passage extends laterally through the side of the body. Passage 7 serves to conduct heated water from the tank to the water system.

As shown in FIG. 1, body 6 extends through opening 4 in head 2 and the upper end of body 6 is formed with a cam-shaped flange 8 which is supported on the upper surface of head 2 bordering opening 4.

An elongated anode 9 formed of a metal electro-negative to steel, such as aluminum, magnesium or zinc, is connected to the lower end of body 6. In this regard, body 6 is formed with an axial recess 10 and the upper end of anode 9 is press fitted in the recess. As seen in FIG. 1, anode 9 can be provided with a circumferential shoulder or ledge 11 which bears against the lower end of body 6 to provide added support for the elongated anode.

A steel core wire 12 is located centrally of anode 9 and the upper end of core wire 12 projects beyond the end of anode 9 and is received within a hole in an electrical connector or lead 13. As shown in the drawings, connector 13 can be in the form of a metal strap and the end of core wire 12 is secured within a hole in the strap by means of a weld 14.

Electrical connector 13 is embedded in plastic body 6 and the upper end of the connector extends laterally and is exposed through at periphery of cam 8, as indicated by 15.

To fabricate the construction of the invention, core wire 12 of anode 9 is initially welded to one end of the electrical connector 13. The anode along with connector 13 is then placed in a mold and the plastic body 6 is molded around the end of the anode and encapsulates the connector 13.

To install the unit with tank 1, the anode 9 along with the attached body 6 is dropped through the opening 4 in upper head 2 until cam 8 engages the upper surface of the head. At this time the outer periphery or nose of the cam will be out of contact with internal threads of spud 5. The upper end of passage 7, as shown in FIG. 2, is provided with a hexagonal or other non-circular opening and a tool is inserted within the passage 7 to rotate the body 6 relative to spud 5. Rotation will cause the nose of cam 8 to wedge against the internal thread of spud 5, as seen in FIG. 3, thus providing a positive electrical connection between the exposed end 15 of connector 13 and spud 5. Wedging engagement of the cam 8 with the threads in the spud 5 will lock the body 6 relative to the spud to prevent rotation therebetween.

After assembly of the body 6, a tubular metal nipple 16 can be threaded into the upper end of spud 5, as shown in FIG. 1.

The invention combines the anode mount and the hot water outlet in a single opening in the tank head thereby eliminating the cost of a second head opening.

A positive electrical connection is provided between the core wire 12 of anode 9 and the electrical connector 13, as well as between the connector and the spud 5, thus eliminating problems that have been encountered in the past with using a compression rolling method to provide electrical contact.

As the body or fitting 6 is formed of a non-metallic material, there are no exposed metal components that have to be protected against corrosion, thus eliminating any potential intensified corrosion of the anode adjacent the fitting which can result in "necking down" of the anode.

Various modes of carrying out the invention are contemplated as being within the scope of the following claims particularly pointing out and distinctly claiming the subject matter which is regarded as the invention.

1. In a water heater, a tank to contain water to be heated and having an upper head with an opening therein, an annular metal spud secured to the upper head and having an aperture communicating with said opening, a body formed of an electrically insulating material, said body extending through said opening and having an upper end disposed within the aperture of said spud, passage means in said body with one end of said passage means extending through the side of said body and communicating with said tank and the other end of said passage means extending to the upper end of said body whereby heated water in the tank can flow through said passage means for discharge, an anode formed of a metal electro-negative to steel and secured to the lower end of said body, electrical connecting means connected to said anode and having an upper end disposed at the upper end of said body, and laterally extending cam means on the upper end of said body, said cam means being constructed and arranged so that rotation of said body relative to said spud will wedge said cam means into engagement with said spud and effect a positive electrical connection between the upper end of said electrical connecting means and said spud.

2. The water heater of claim 1, wherein said elctrical connecting means is embedded within said body and the upper end of said electrical connecting means is exposed at said cam means.

3. The water heater of claim 1, wherein said anode includes a steel core wire, said core wire being connected to said electrical connecting means.

4. The water heater of claim 1, and including means on the upper end of said body for effecting rotation of said body relative to said spud.

5. The water heater of claim 4, wherein said means for effecting rotation of said body comprises means to receive a tool.

6. The water heater of claim 1, wherein the upper end of said body has a smaller cross sectional area than the aperture of said spud.

7. The water heater of claim 1, wherein said electrical connecting means is exposed at the periphery of said cam means.

8. In a water heater, a tank to contain water to be heated and having an upper head with an opening therein, an annular metal spud having an internal aperture of larger diameter than said opening, said spud being secured to the upper surface of said head and said aperture being disposed eccentrically with respect to said opening, a body formed of an electrically insulating material and disposed within said opening, passage means in said body with a first end of said passage means being exposed through a side of said body and a second end of said passage means being exposed at the upper end of said body whereby heated water from said tank can flow through said passage means for discharge, an anode formed of a metal electro-negative to steel and secured to the lower end of said body, an electrical connector connected to said anode and embedded within said body, laterally extending eccentric means on the upper end of said body and disposed within said aperture, an end of said electrical connector being exposed at said eccentric means, and means for effecting rotation of said body within said opening to thereby move said eccentric means into wedging contact with said spud to provide a positive electrical connection between the end of said connector and said spud.

9. The water heater of claim 8, wherein said spud has an internal thread and said eccentric means is wedged into contact with said internal thread.

10. The water heater of claim 8, wherein said means for effecting rotation comprises means in the upper end of said body to receive a tool.

11. The water heater of claim 8, wherein said body is molded of plastic.

12. The water heater of claim 9, wherein said anode includes a steel core wire and the upper end of said core wire projects beyond the upper end of said anode, said electrical connector being secured to the projecting end of said core wire.

13. The water heater of claim 12, and including weld means for welding said upper end of the core wire to said connector.

14. In a water heater, a tank to contain water to be heated and having an upper head with an opening therein, an annular metal spud secured to the upper head and having an aperture communicating with said opening, a body formed of an electrically insulating material, said body extending through said opening and having an upper end disposed within the aperture of said spud, passage means in said body with one end of said passage means extending through the side of said body and communicating with said tank and the other end of said passage means extending to the upper end of said body whereby heated water in the tank can flow through said passage means for discharge, a cam member secured to the upper end of said body, the lower end of said body having an axial recess, an anode formed of a metal electro-negative to steel and having an upper end disposed within said recess, a core wire disposed centrally of said anode with the upper end of the core wire projecting beyond the upper end of said anode, and a metal connector embedded in said body and having a first portion secured to the projecting end of said core wire and having a second portion exposed at the periphery of said cam member, rotation of said body within the opening in said head moving said cam member into engagement with the internal thread of said spud to wedge said cam member and said exposed second portion against the inner surface of said spud to provide a positive electrical connection between said connector and said spud.

15. The water heater of claim 14, and including a tubular metal nipple having an external thread engaged with the upper end of said spud.

16. The water heater of claim 14, wherein said cam member extends laterally of said body and rests on the upper surface of said head.

17. The water heater of claim 14, wherein the opening in said head has a smaller diameter than said aperture.

18. In a water heater, a tank to contain water to be heated and having an upper head with an opening therein, an annular metal spud secured to the upper surface of said head and having an aperture communicating with said opening, said aperture having a larger diameter than said opening and disposed eccentrically with respect to said opening, a body formed of an electrically insulating material, said body extending through said opening, a laterally extending projection on the upper end of said body and disposed within the aperture of said spud, passage means in said body for conducting heated water from said tank, an anode formed of a metal electro-negative to steel and secured to the lower end of said body, and electrical connecting means connected to said anode and having an upper end exposed at said projection, said projection being disposed in engagement with the inner surface of said spud to effect an electrical connection between said anode and said spud.

* * * * *

UNITED STATES PATENT AND TRADEMARK OFFICE

CERTIFICATE OF CORRECTION

PATENT NO. : 4,954,233

DATED : September 4, 1990

INVENTOR(S) : TIMOTHY H. HOULE ET AL

It is certified that error appears in the above-identified patent and that said Letters Patent is hereby corrected as shown below:

Col. 5, Line 42, CLAIM 12 Delete "9" and substitute therefor --8--

Signed and Sealed this

Second Day of June, 1992

*Attest:*

DOUGLAS B. COMER

*Attesting Officer*

*Acting Commissioner of Patents and Trademarks*